US012631020B2

(12) United States Patent
Freidberg

(10) Patent No.: US 12,631,020 B2
(45) Date of Patent: May 19, 2026

(54) FRAMING GASKET

(71) Applicant: LOUISIANA-PACIFIC CORPORATION, Nashville, TN (US)

(72) Inventor: Neil Freidberg, Lebanon, TN (US)

(73) Assignee: LOUISIANA-PACIFIC CORP., Nashville, TN (US)

( * ) Notice: Subject to any disclaimer, the term of this patent is extended or adjusted under 35 U.S.C. 154(b) by 153 days.

(21) Appl. No.: 18/613,012

(22) Filed: Mar. 21, 2024

(65) Prior Publication Data

US 2024/0384527 A1 Nov. 21, 2024

Related U.S. Application Data

(60) Provisional application No. 63/453,519, filed on Mar. 21, 2023.

(51) Int. Cl.
*E04B 1/66* (2006.01)

(52) U.S. Cl.
CPC ..... *E04B 1/66* (2013.01)

(58) Field of Classification Search
CPC ..... E04B 1/66; E04B 1/6815; E06B 2001/628
USPC ..... 52/411, 413, 741.4; 277/307, 497, 906, 277/921; 49/475.1, 480.1
See application file for complete search history.

(56) References Cited

U.S. PATENT DOCUMENTS

| | | | | |
|---|---|---|---|---|
| 2,937,065 | A * | 5/1960 | Camphausen | E01C 11/106 277/649 |
| 3,385,016 | A * | 5/1968 | Crom | E04B 1/6806 52/249 |
| 5,802,779 | A * | 9/1998 | Hulls | A01M 1/2011 52/293.3 |
| 6,578,332 | B2 * | 6/2003 | Bushberger | E04B 1/644 52/274 |
| 7,603,816 | B1 * | 10/2009 | Hohmann, Jr. | E04B 1/2604 43/132.1 |
| 7,721,488 | B1 * | 5/2010 | Bennett | E04F 13/0864 52/302.6 |
| 10,004,218 | B1 * | 6/2018 | Goodspeed | E04B 1/72 |
| 10,400,441 | B1 * | 9/2019 | Bevis | E02D 29/16 |
| 10,900,272 | B2 * | 1/2021 | Glickman | E06B 1/62 |
| 11,408,168 | B2 * | 8/2022 | Sandler | E04B 1/2403 |
| 2009/0107066 | A1 * | 4/2009 | O'Leary | E04B 1/625 52/293.3 |
| 2016/0160497 | A1 * | 6/2016 | Randlett | E04F 13/0839 52/61 |

* cited by examiner

*Primary Examiner* — Patrick J Maestri
(74) *Attorney, Agent, or Firm* — Wayne Edward Ramage; Baker Donelson

(57) ABSTRACT

A framing gasket for use in construction. The gasket has a base with a plurality of rows of raised elements extending upward from one surface, each row with a stem-and-cap profile in cross section, with a stem extending upward from the first surface to a cap. The gasket is flexible and deformable, and provides a flexible air seal between framing elements in a building or structure wall. The profile allows for natural voids and deformation in framing elements while maintaining an air seal.

14 Claims, 6 Drawing Sheets

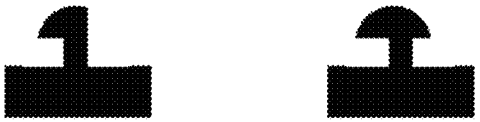
FIG. 4A
FIG. 4B
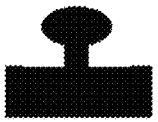
FIG. 4C
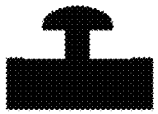
FIG. 4D
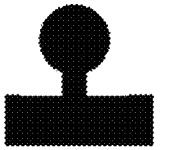
FIG. 4E
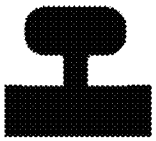
FIG. 4F
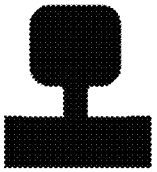
FIG. 4G
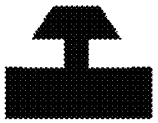
FIG. 4H
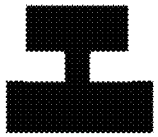
FIG. 4I
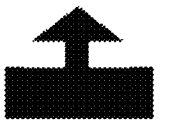
FIG. 4J

FRAMING GASKET

This patent application claims priority to and benefit of U.S. Provisional Application No. 63/453,519, filed Mar. 21, 2023, which is incorporated herein by specific reference in its entirety by specific reference for all purposes.

FIELD OF INVENTION

This invention relates to a gasket with a plurality of stem and cap profiled rows on one face, configured to provide a flexible air seal between framing elements in a building wall.

BACKGROUND OF INVENTION

In the residential and commercial construction industry, it is desirable to have air-tight buildings and structures for energy-efficiency, durability, and comfort of use. A significant element of achieving this goal is air sealing the framing of the building or structure. This can be done with application of caulk or liquid sealants, the spraying of foam, or foam framing gasket tape. Foam framing gasket tape as known in the prior art has two flat sides, both with adhesive. During construction of a framing element, the tape is rolled to adhere to the edge of a stud during construction of the framing element, the liner on the other side of the tape is removed and exterior sheathing is laid on top of the framing element and nailed to the assembly. The foam tape is not readily deformable, however, and as the building or structure moves and settles post-construction, voids and air pathways often form in the gasket or other air sealants, causing the building or structure to become less air-tight.

Accordingly, what is needed is a flexible and deformable framing gasket that maintains air-tightness despite deformation and voids that may form in the framing and building structure.

SUMMARY OF INVENTION

In various exemplary embodiments, the present invention comprises a flexible, deformable gasket with a specific profile configured to provide a flexible air seal between framing elements in a building wall. The profile allows for natural voids and deformation in framing elements, and provides a plurality of taller (higher) points and shorter (lower) points on one side or face of the gasket.

In one exemplary embodiment, the gasket comprises a flexible rectilinear strip or roll, with an adhesive backing, which may have a liner, on one side, while the opposite side does not have an adhesive layer. Instead, it comprises a plurality of rows of higher points comprising a stem and convex-cap (i.e., mushroom cap) shape in cross-section. These rows extend for the length of the gasket strip or roll. The entire gasket is made of flexible, deformable material, such as, but not limited to, rubber or polyethylene material, such as, but not limited to, closed-cell extruded polystyrene foam (XPS).

In application, portions of the gasket strip or roll may be cut off as desired to fit a particular space or opening. Alternatively, the gasket strip or rolled may be unrolled and stapled or adhered to the building structure or frame underneath a sheathing component, such as, but not limited to, a panel. The gasket material is then compressed under the sheathing component when the latter is attached (by stapling, nailing, screwing, or other similar means) to the building structure or frame as part of a wall or other building element.

The distinct and unique profile of the present invention provides a flexible air seal for the structure, so that the building moves and settles, the gasket is able to move and flex as well, maintaining the air seal despite deformation and voids that may form in the framing and building structure. The individual convex heads (i.e., the "mushroom caps") help block air pathways that may form, as well as adapting more easily to variations in a cavity or void.

In some embodiments, two or more gasket rolls may be used together. For example, two rolls may be placed so their profile faces meet and interlock, with the outer faces on both sides being flat. Alternatively, the two rolls may be placed so their flat sides meet (and they may be affixed together by adhesive or similar means), with their profiles facing outwards.

While the profile is described as being in the form of a stem with convex, curved cap (i.e., mushroom shaped), variations of a stem-and-cap profile may be used. For example, the cap may overhang the stem only on one side, with the opposite side being even with the side of the stem. Alternatively, both sides may overhang, but at different distances. In further embodiments, the cap may be other shapes, such as square, rectilinear, or triangular/pyramidal.

BRIEF DESCRIPTION OF THE DRAWINGS

FIGS. 4A-J show cross-sectional views of a single row from a gasket with alternative stem-and-cap profiles.

DETAILED DESCRIPTION OF EXEMPLARY EMBODIMENTS

In various exemplary embodiments, the present invention comprises a flexible, deformable gasket with a specific profile configured to provide a flexible air seal between framing elements in a building wall. The profile allows for natural voids and deformation in framing elements, and provides a plurality of taller (higher) points and shorter (lower) points on one side or face of the gasket.

Figure 1:
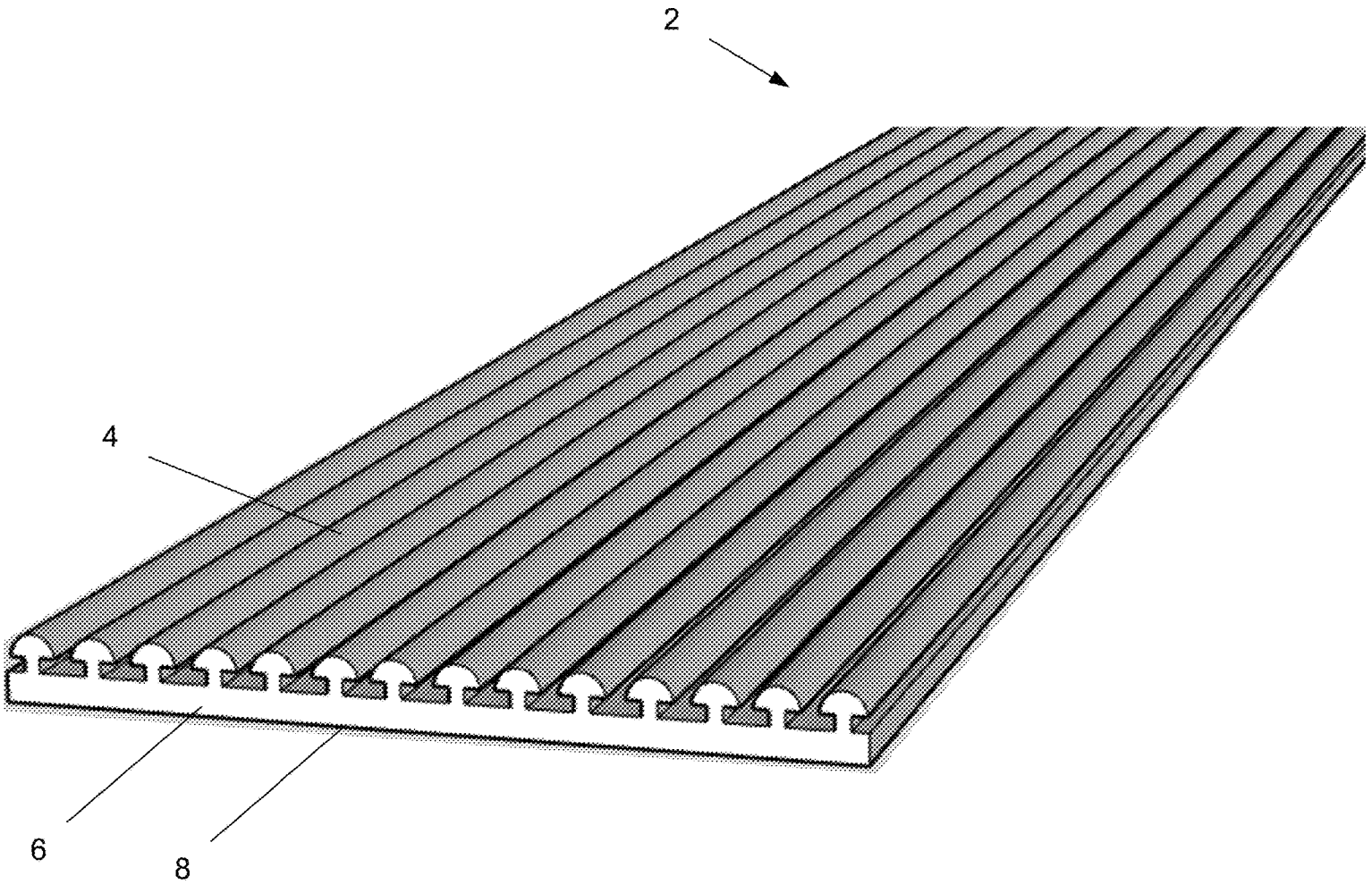
FIG. 1 shows a perspective view of a gasket with a mushroom-cap profile in accordance with the present invention.
Figure 2:
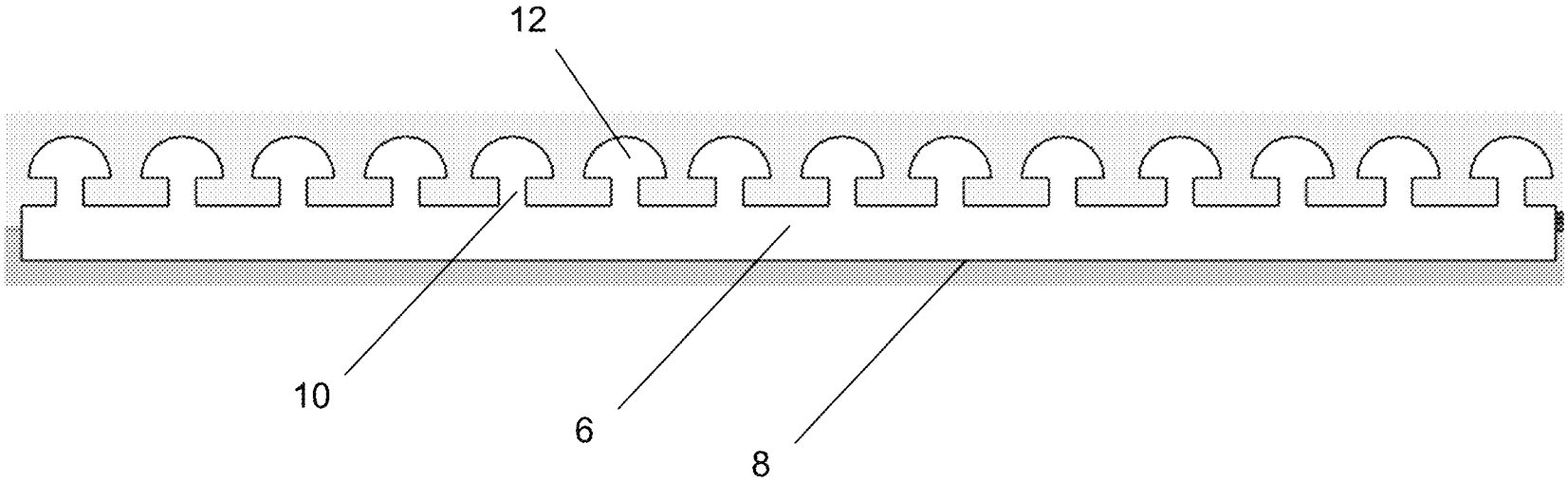
FIGS. 2 and 3 show cross-sectional views of the gasket of FIG. 1.
Figure 3:
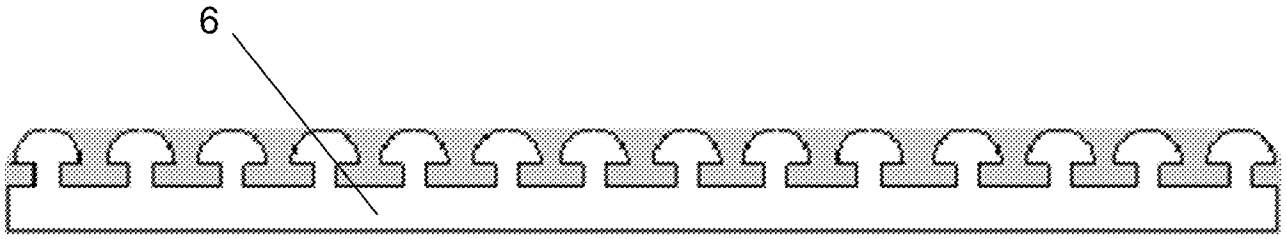

In the embodiment shown in FIGS. 1-3, the gasket comprises a flexible rectilinear strip or roll 2, with a base 6, which may have an adhesive layer or backing 8, with plurality of rows 4 of raised elements or higher points. Each row comprises a stem 10 and cap 12 shape in cross-section. These rows 4 extend for the length of the gasket strip or roll 2. The entire gasket is made of flexible, deformable material, such as, but not limited to, rubber or polyethylene material, such as, but not limited to, closed-cell extruded polystyrene foam (XPS). In several embodiments, the gasket material is resiliently deformable (i.e., the material deforms elastically when subject to a load, without creating a permanent distortion, and when unloaded, rebounds to its original shape and form).

Figure 5:
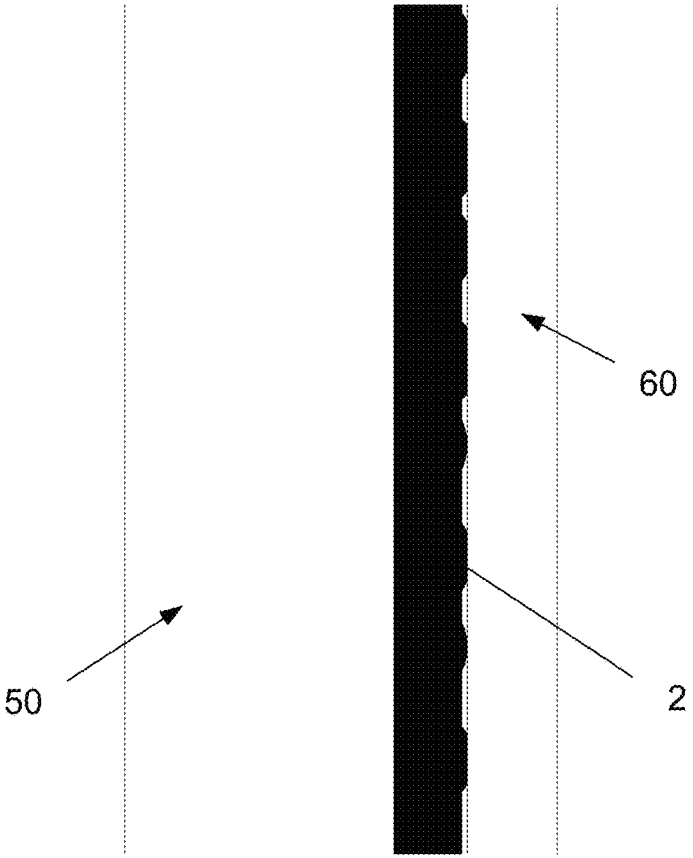
FIG. 5 shows a side view of a framing structure with framing gasket and structural sheathing panel.
Figure 6:
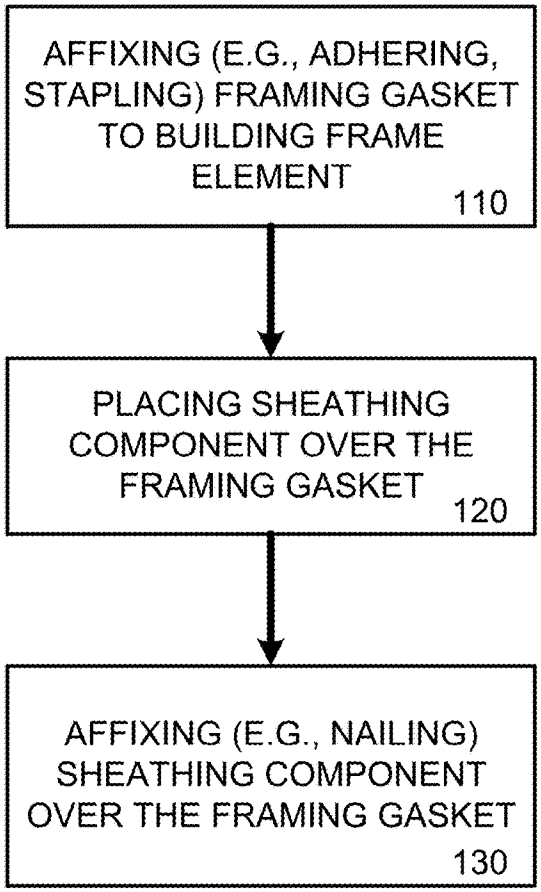
FIG. 6 shows a diagram of the steps for installation of a framing gasket on a framing structure and under a sheathing component, such as a panel or structural sheathing panel.

In application, portions of the gasket strip or roll 4 may be cut off as desired to fit a particular space or opening. Alternatively, the gasket strip or roll 2 may be unrolled and stapled or adhered 110 to the building structure or frame 50, then positioned or placed underneath 120 a sheathing component, such as, but not limited to, a panel or structural sheathing panel 60. The gasket material is then compressed under the sheathing component when the latter is attached (by stapling, nailing, screwing, or other similar means) 130 to the building structure or frame as part of a wall or other building element, as seen in FIG. 5 and FIG. 6. The flexibility and deformability of the gasket material may form an air seal around the nail, screw, staple, or other fastener.

The distinct and unique profile of the present invention provides a flexible air seal for the structure, so that as the building moves and settles, the gasket is able to move and flex as well, maintaining the air seal despite deformation and voids that may form in the framing and building structure. The individual caps or convex heads (i.e., the "mushroom caps" seen in FIG. 1-3) help block air pathways that may form, as well as adapting more easily to variations in height or depth, such as a cavity or void in the framing or framing element.

In some embodiments, two or more gasket rolls 2 may be used together. For example, two rolls may be placed so their profiled faces meet and interlock, with the outer faces on both sides being flat. Alternatively, the two rolls may be placed so their flat sides meet (and they may be affixed together by adhesive or similar means), with their profiles facing outwards.

As seen in FIG. 1-3, the rows have a stem with a convex, curved cap (e.g., mushroom-shaped) profile. In addition to helping to block air pathways that may form, this configuration allows for the profiled faces of two gasket rolls to more easily interlock, as the curved profile directs the cap into the space between the corresponding stems on the other gasket roll. It should be noted that the cap and stem each have a width, and in the embodiment shown, the width of the widest part of the cap is greater than the width of the stem. In this embodiment, the spacing of the rows is such that the distance between interior facing sides of the stem of adjacent rows is as large as or slightly larger than the width of the widest part of the corresponding caps (e.g., 100%, no more than 105%, no more than 110%, or no more than 125%, of the width of the widest part of the caps), thereby promoting interlocking between the profiled faces. In particular, the lower edges of the corresponding caps meet and interface, resisting separation once interlocked.

Variations of a stem-and-cap profile, or similar profile, may be used as seen in FIG. 4A-J, which show a cross-section profile view of a single row from a segment of gasket roll. For example, as seen in FIG. 4A the cap may overhang the stem only on one side, with the opposite side being even with the side of the stem. Alternatively, both sides of the cap may overhang, but at different distances, as seen in FIG. 4B. In further embodiments, the cap may be other shapes, including, but not limited to, an oval (FIG. 4C), flattened curve (FIG. 4D), a circle (FIG. 4E), a square or rectilinear shape with rounded or orthogonal corners (FIGS. 4F, G, I), a trapezoid (FIG. 4H), or a triangular/pyramidal shape (FIG. 4J), or combinations thereof.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A framing component for use in constructions, comprising:

a framing gasket with a base with a first surface;

a plurality of rows of raised elements extending upward from the first surface, each row with a stem-and-cap profile in cross section, with a stem extending upward from the first surface to a cap; and an adhesive layer or back affixed to a second surface of the base;

wherein the framing gasket comprises flexible and deformable material.

2. The framing component of claim 1, wherein the framing gasket material is resiliently deformable.

3. The framing component of claim 1, wherein the framing gasket material comprises rubber, polyethylene, and/or extruded polystyrene foam (XPS).

4. The framing component of claim 1, wherein the base and plurality of rows are continuous and integrated.

5. The framing component of claim 1, wherein the base is rectilinear with a length, and the rows extend for the length of the base.

6. The framing component of claim 1, wherein the plurality of rows of raised elements are parallel to each other.

7. The framing component of claim 1, wherein the cap has a width and the stem has a width, and the widest width of the cap is greater than the width of the stem.

8. The framing component of claim 7, wherein the plurality of rows are evenly spaced at a first distance between facing sides of the stems in adjacent rows such that the first distance is no greater than 125% of the widest width of the caps.

9. A method of sealing a building frame, comprising the steps of:

affixing a framing gasket to a building frame element, said framing gasket comprising a base with a first surface, a plurality of rows of raised elements extending upward from the first surface, each row with a stem-and-cap profile in cross section, with a stem extending upward from the first surface to a cap, wherein the framing gasket comprises flexible and deformable material;

placing a sheathing component over the framing gasket; and affixing the sheathing component to the building frame element, thereby compressing the framing gasket between the sheathing component and the building frame element.

10. The method of claim 9, wherein the step of affixing a framing gasket comprises adhering a side of the framing gasket to the building frame element.

11. The method of claim 9, wherein the step of affixing a framing gasket comprises stapling the framing gasket to the building frame element.

12. The method of claim 9, wherein the step of affixing a sheathing component comprises nailing the sheathing component with one or more nails to the building frame element.

13. The method of claim 12, wherein at least one of said one or more nails penetrates the framing gasket.

14. The method of claim 13, wherein the framing gasket forms an air seal around the nail.

* * * * *